US005957737A

United States Patent [19]

Ozai

[11] Patent Number: 5,957,737

[45] Date of Patent: Sep. 28, 1999

[54] CONNECTION PORTION OF CONTACT

[75] Inventor: Kazuyuki Ozai, Tokyo, Japan

[73] Assignee: DDK Ltd., Japan

[21] Appl. No.: 08/995,487

[22] Filed: Dec. 22, 1997

[30] Foreign Application Priority Data

Jan. 8, 1997 [JP] Japan ..... 9-013085

[51] Int. Cl.[6] ..... H01R 4/10

[52] U.S. Cl. ..... 439/877

[58] Field of Search ..... 439/877

[56] References Cited

U.S. PATENT DOCUMENTS 4,840,578 6/1989 Sato ..... 439/877

5,245,132 9/1993 Luetzow ..... 439/877

5,281,760 1/1994 Kikuchi et al. ..... 439/877

5,356,318 10/1994 Fry et al. ..... 439/877

*Primary Examiner*—Hien Vu

*Assistant Examiner*—Briggitte R. Hammond

*Attorney, Agent, or Firm*—Silverman, Cass & Singer, Ltd.

[57] ABSTRACT

A connection portion of a contact for use in an electrical connector or the like. The connection portion is in the form of a substantially U-shaped groove, to which is connected an exposed conductor of an electric wire. The connection portion includes on both sides bending pieces forming the walls of the U-shaped groove and asymmetrically arranged. With this construction, a relatively deep and wide groove of the connection portion is obtained even if the contact itself is small.

3 Claims, 9 Drawing Sheets

CONNECTION PORTION OF CONTACT

BACKGROUND OF THE INVENTION

This invention relates to a connection portion of a contact for use in an electrical part, such as, an electrical connector.

Inside an electrical part, for example, an electrical connector, there are provided contacts made of worked metal pieces, each having on the one hand a connection portion in the form of a substantially U-shaped groove formed by bent parts of the contact, to which is connected an exposed conductor of an electric wire by soldering or solderless joining and on the other hand a contact portion adapted to be in contact with a contact of a mating connector.

These contacts have been produced in various methods. With miniaturization of electrical connectors themselves and high density distribution of contacts in electrical connectors, the contacts themselves have also been required to be miniaturized. Under such circumstances, a great number of contacts have been continuously produced in mass production by punching a long metal tape or a wide metal sheet of, for example, copper, and then by bending the punched blank pieces. Such a production method is high in productivity making it possible to reduce the cost per contact.

In the connection portion of a hitherto used contact, which is in the form of a substantially U-shaped groove, extension pieces are bent to form the walls of the U-shaped groove for enclosing an exposed conductor of an electric wire in order to connect it to the connection portion of the contact. However, the extension pieces prior to being bent are in general rectangular (or square), which are the same in shape and arranged on both sides of and symmetrically with respect to the longitudinal axis of the contact. In the case that the contacts themselves are miniaturized and produced in mass production, it is needed to make minimum the pitch between the contacts so that the extension pieces forming the walls of connection portions of the contacts need to have narrower widths in the direction perpendicular to the longitudinal axis of the contacts.

In this case, however, such narrower widths of the extension pieces could not provide a groove-shaped connection portion having a sufficient depth or width. Such a connection portion having a shallow or narrow groove does not effectively enclose an exposed conductor of an electric wire and makes it impossible to apply a sufficient amount of solder in soldering or cannot achieve a sufficient strength at the solderless joint.

If the widths of extension pieces of the contact are made wider, it may be possible to overcome these problems. However, such wider extension pieces make larger the pitch between contacts in a metal tape or sheet to lower the yield or productivity so that a great amount of waste material could not be avoided.

SUMMARY OF THE INVENTION

It is an object of the invention to provide a connection portion of a contact for use in an electrical connector or the like, which eliminates all the disadvantages of the prior art.

In order to accomplish this object, in a connection portion of a contact, which is in the form of a substantially U-shaped groove and to which is connected an exposed conductor of an electric wire, according to the invention bending pieces forming both the walls of the U-shaped groove of the connection portion are asymmetrically arranged.

In another aspect of the invention, the bending pieces forming both the walls of the U-shaped groove of the connection portion are asymmetrically arranged and are shifted to each other in the longitudinal axis of the contact.

As can be seen from the above explanation, the connection portion of a contact according to the invention has the following significant effects.

(1) First, as the bending pieces forming the connection portion of the contact on its both sides are asymmetrically formed in the form of the trapezoids or rectangles alternately shifted, a deep and wide groove can be obtained in appearance, irrespective of the small connection portion of the miniaturized contact itself. As a result, the present invention can provide a miniaturized or microstructure contact which meets the requirements for electrical connectors to be miniaturized and for contacts to be arranged in high density inside the electrical connectors. It is of course possible for the connection portion according to the invention to enclose an exposed conductor of an electric wire stably and to apply a required amount of solder owing to the deep and wide groove, thereby ensuring a connection with high reliability.

(2) As the bending pieces forming the connection portion of the contact on its both sides are asymmetrically formed in the form of the trapezoids or rectangles alternately shifted, the yield of the material in production steps is improved owing to the effective limitation of waste material to the minimum, thereby achieving a further reduction in the cost per contact and hence a further decrease in production cost.

(3) In case of producing an electrical connector using the contacts according to the invention, good insulation between the adjacent connection portions of adjacent contacts can be accomplished, even if they are arranged in high density in order to meet the requirement to miniaturize the electrical connector itself and to arrange the contacts in high density in the electrical connector. Moreover, the capacitance of connection portions of the adjacent contacts is reduced to minimize the cross talk so that the contacts according to the invention can be advantageously used with electrical signals of higher frequencies to more improve the transmission characteristics of electrical or electronic equipment.

(4) With the contacts according to the invention, moreover, they are arranged very closely to one another in an electrical connector or with a pitch substantially the same as the pitch of contacts being punched from a metal tape so that waste material is little, while the high density arrangement of contacts is possible.

The invention will be more fully understood by referring to the following detailed specification and claims taken in connection with the appended drawings.

DESCRIPTION OF THE PREFERRED EMBODIMENTS

Figure 1:
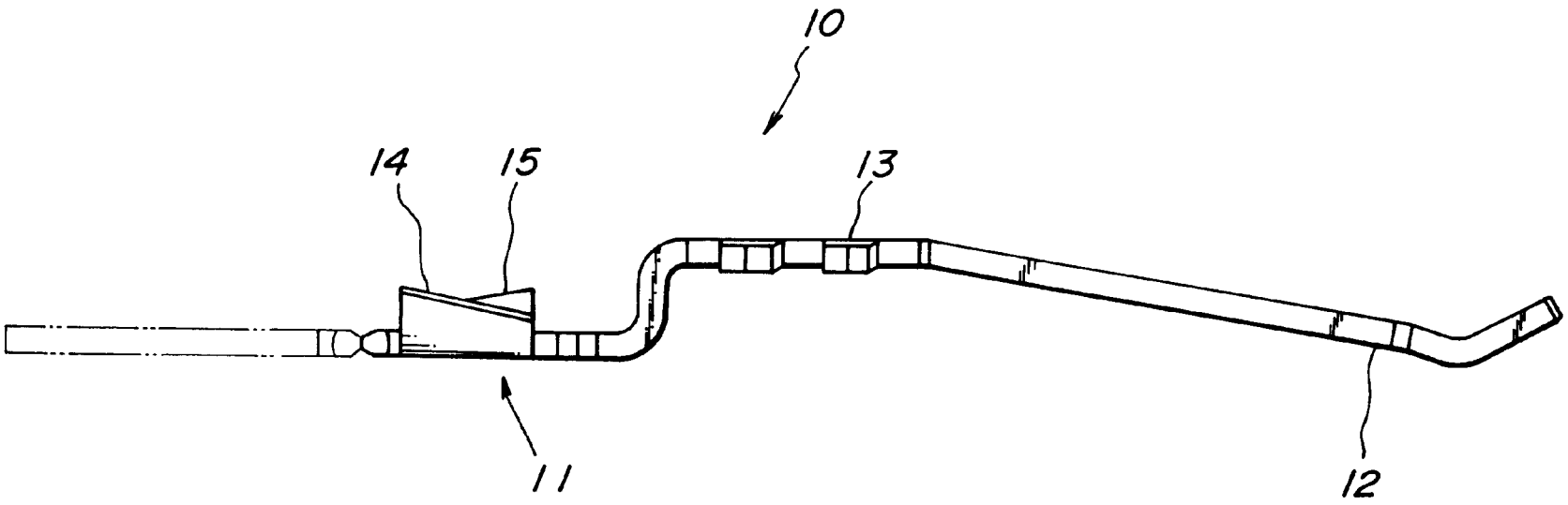
FIG. 1 is an enlarged side view illustrating a contact according to one embodiment of the invention.

FIG. 1 illustrates a contact of an electrical connector according to one embodiment of the invention. The contact 10 shown in FIG. 1 comprises a connection portion 11 in the form of a substantially U-shaped groove, to which is connected by soldering an exposed conductor of an electric wire, a contact portion 12 at one end adapted to be in contact with a contact of a mating connector, and a fixed portion 13 to be fixed to a case made of a resin as a main body of the electrical connector.

Figure 2:
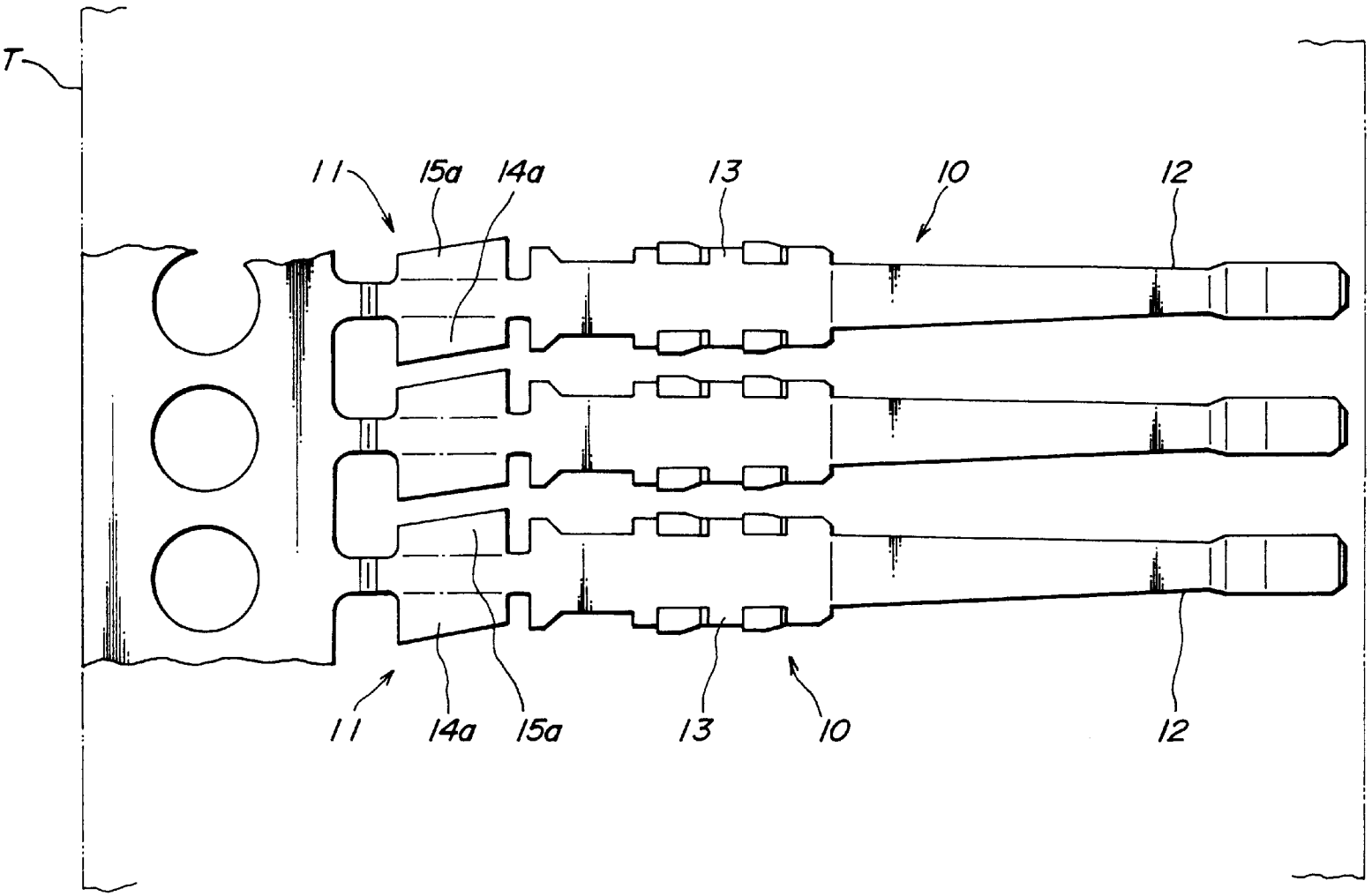
FIG. 2 is a plan view illustrating the intermediate step for producing the contact shown in FIG. 1.

Preferably, a number of such contacts thus constructed are continuously formed in mass production from a long metal tape T, such as a copper plate by means of punching and bending processes as shown in FIG. 2. If required, produced contacts 10 may be plated with solder or the like on their surfaces.

As shown in FIG. 2, in the flat state of the contact 10 whose bending pieces 14 and 15 have not been bent, the connection portion 11 includes both extension pieces 14*a* and 15*a* extending outwardly from the contact body on both sides thereof in a manner to form trapezoid shapes, respectively, asymmetrical to each other with respect to the axial direction of the contact. The outer edges of both the trapezoids (upper and lower edges viewed in FIG. 2) are inclined to the axial direction of the contact.

Figure 3:
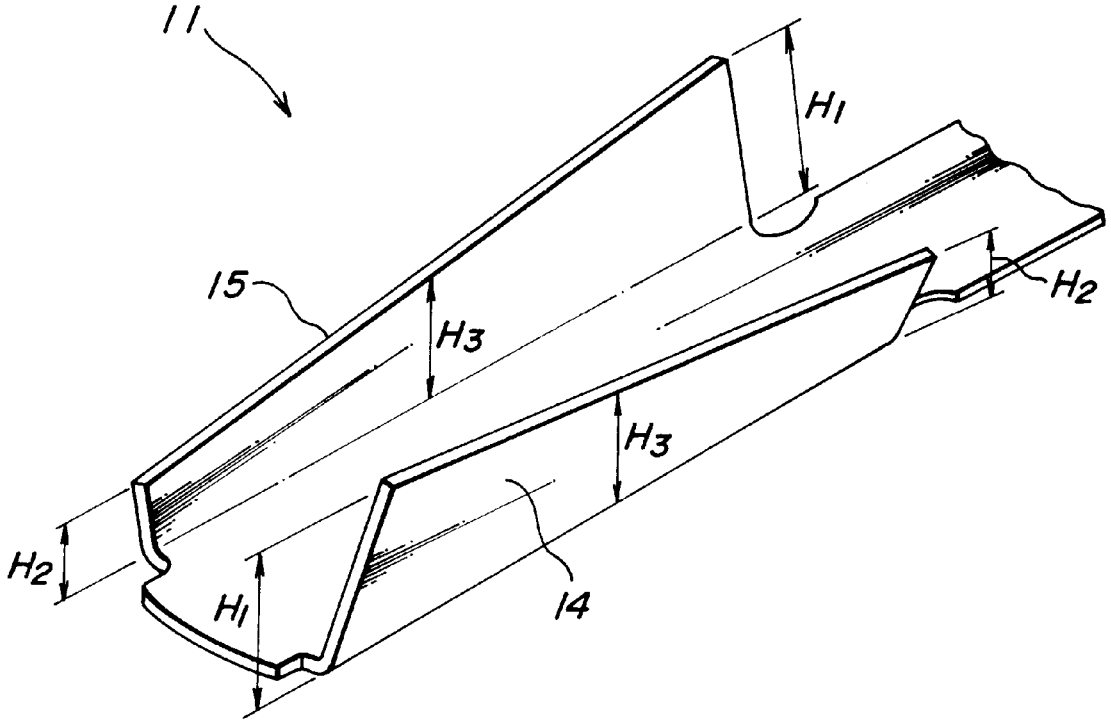
FIG. 3 is an enlarged perspective view showing the connection portion of the contact in FIG. 1.

Both the extension pieces 14*a* and 15*a* are then bent so as to form both the bending pieces 14 and 15 resulting in the connection portion 11 in the form of a substantially U-shaped groove as shown in FIG. 3. With this connection portion 11 thus constructed in the form of the U-shaped groove, the bending pieces 14 and 15 forming side walls of the U-shaped groove are opposite to each other in a manner such that the highest wall portions H1 and the lowest wall portions H2 are opposite to each other at both the ends of the bending pieces 14 and 15, respectively, and the intermediate height wall portions H3 are also opposite to each other substantially at the center portions of the bending pieces 14 and 15.

In other words, with the relation between the two trapezoids, the shorter base of the one trapezoid is opposite to the longer base of the other trapezoid at one end of the U-shaped groove and the shorter base of the other trapezoid is opposite to the larger base of the one trapezoid at the other end of the U-shaped groove.

Although the overall size of the connection portion 11 is small, a deep or wide U-shaped groove is obtained in appearance, owing to the existence of the highest wall portions H1 at the longitudinal ends of the connection portion 11.

Figure 4:
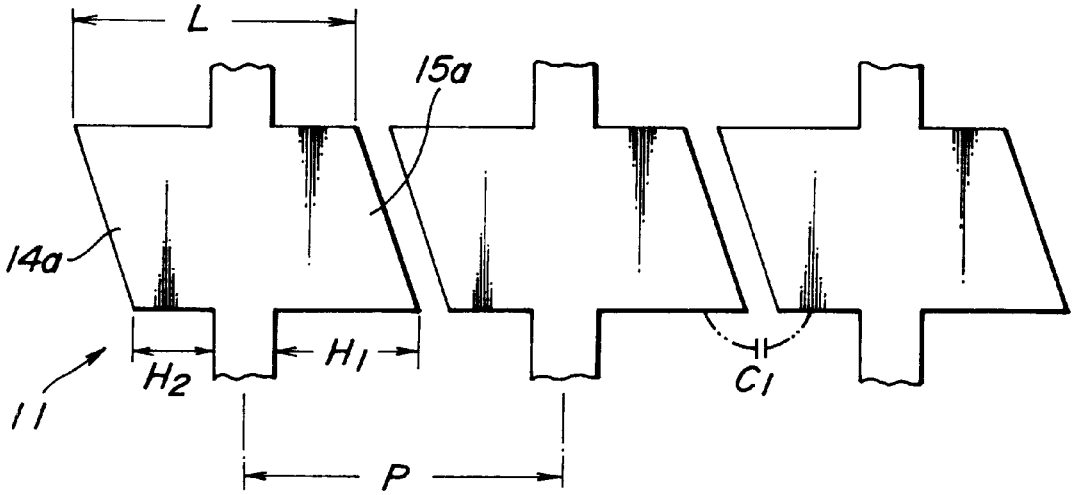
FIG. 4 is an enlarged plan view illustrating the connection portions of the contacts in the development state according to the invention.
Figure 5:
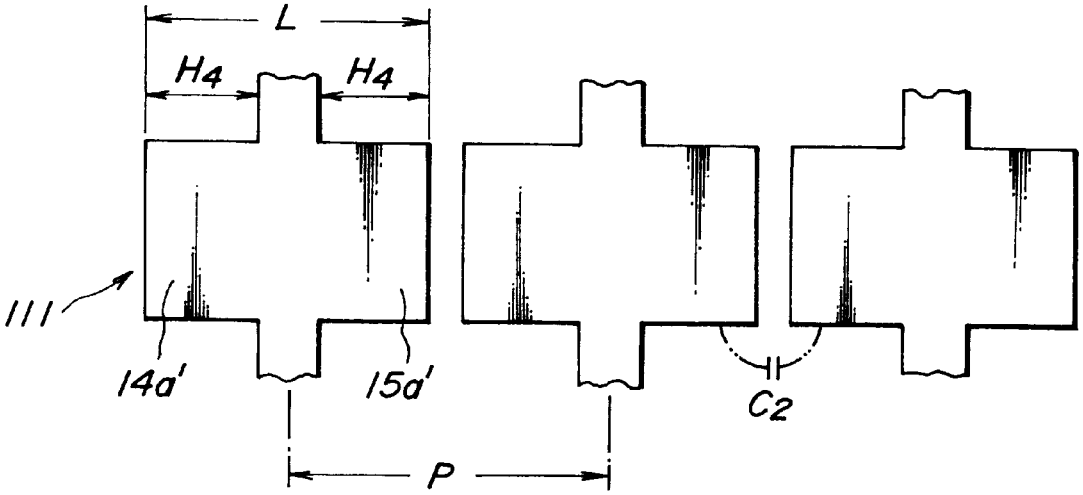
FIG 5 PRIOR ART
FIG. 5 is an enlarged plan view illustrating the connection portions of the contacts of the prior art in the development state.

This fact is more apparent in the comparison of the connection portion 11 of the contact 10 according to the invention shown in FIG. 4 with the connection portion 111 of the prior art shown in FIG. 5. In the respective connection portions 11 and 111, the overall width L of the connection portion 11 including the width of the contact body and both the widths (heights) of the extension pieces 14*a* and 15*a* is equal to the overall width L of the connection portion 111 including the width of the contact body and both the widths (heights) of the extension pieces 14*a*' and 15*a*'. The pitch between adjacent connection portions 11 is also equal to the pitch between adjacent connection portions 111.

First, with the connection portion 111 of the prior art, both the extension pieces 14*a*' and 15*a*' are in the form of a rectangle whose outer sides are in parallel with the axial direction of the contact so that the widths H4 of the extension pieces in the traverse direction are equal to each other. Therefore, when the extension pieces 14*a*' and 15*a*' are bent to form the connection portion in the form of the U-shaped groove, the heights H4 of both the walls are equal to each other over the overall length of the connection portion 111. This means that the shorter the overall width L, the shallower is the depth of the obtained U-shaped groove and the narrower is the width of the U-shaped groove.

In contrast herewith, with the connection portion 11 according to the invention, although the height H2 at one end of the each extension piece 14*a* or 15*a* is lower, the height H1 at the other end of the each extension piece is higher than the height H4 of the extension pieces 14*a*' and 15*a*' of the prior art. Consequently, the highest wall portions H1 are opposite to the lowest wall portions H2 at both the ends of the U-shaped groove, and intermediate height wall portions H3 are opposite to each other at the middle of the wall portions as shown in FIG. 3. Therefore, the deeper and wider groove can be obtained with the aid of the highest wall portions H1 at both the ends of the U-shaped groove than in the connection portion 111 of the prior art.

Figure 6:
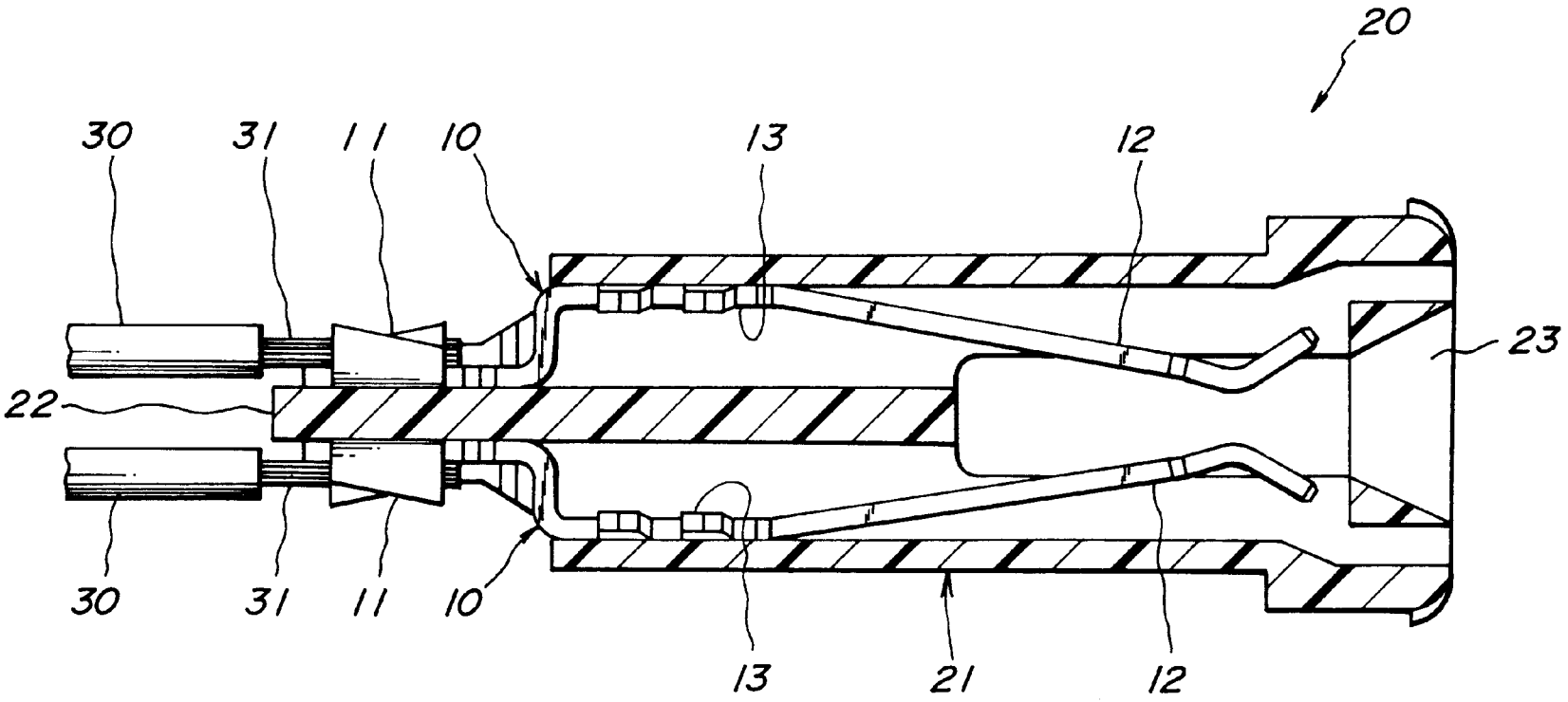
FIG. 6 is an enlarged longitudinal sectional view illustrating one example of an electrical connector to which the contacts according to the invention are applied.
Figure 7:
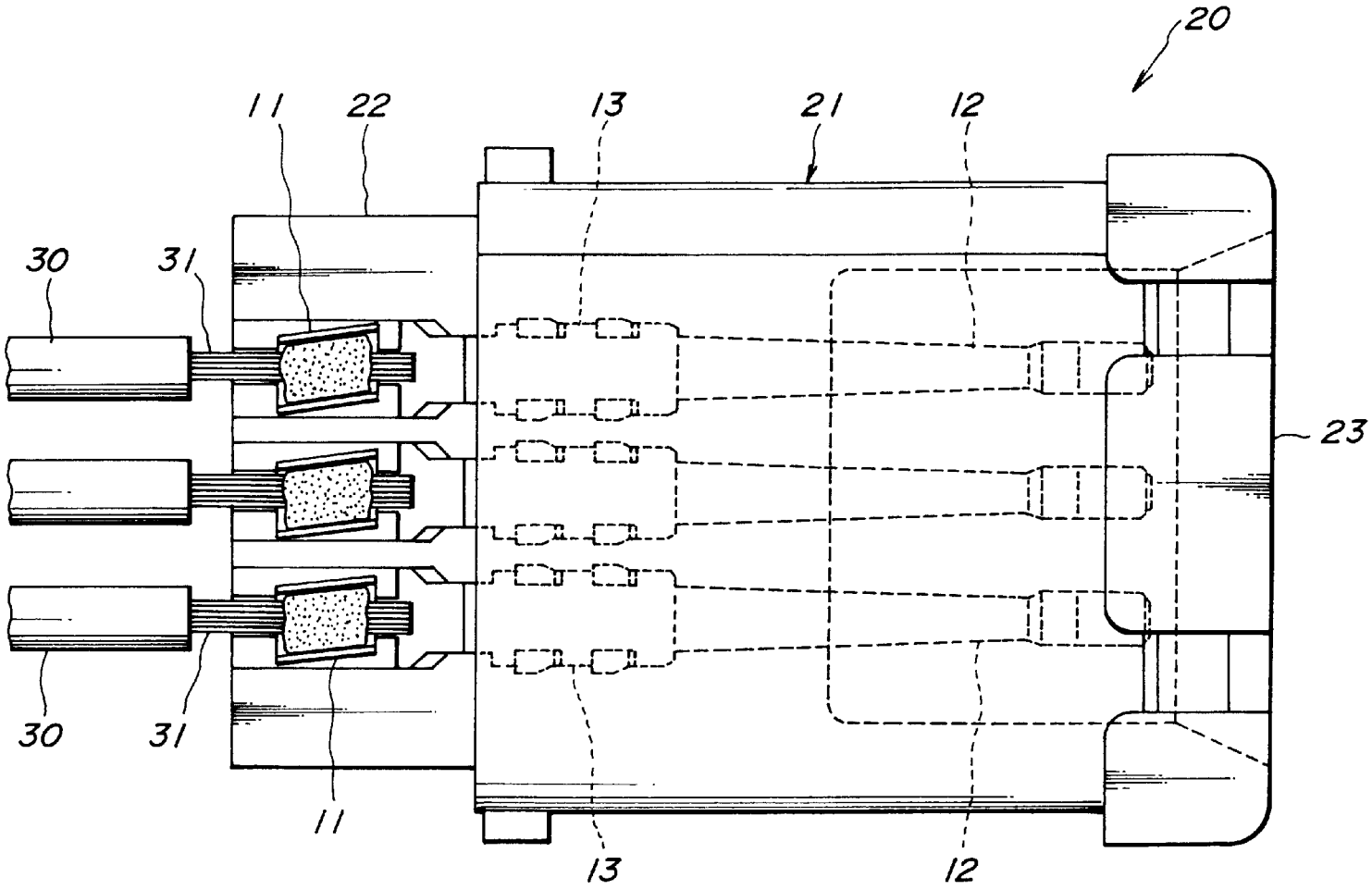
FIG. 7 is a plan view showing the electrical connector shown in FIG. 6.
Figure 8:
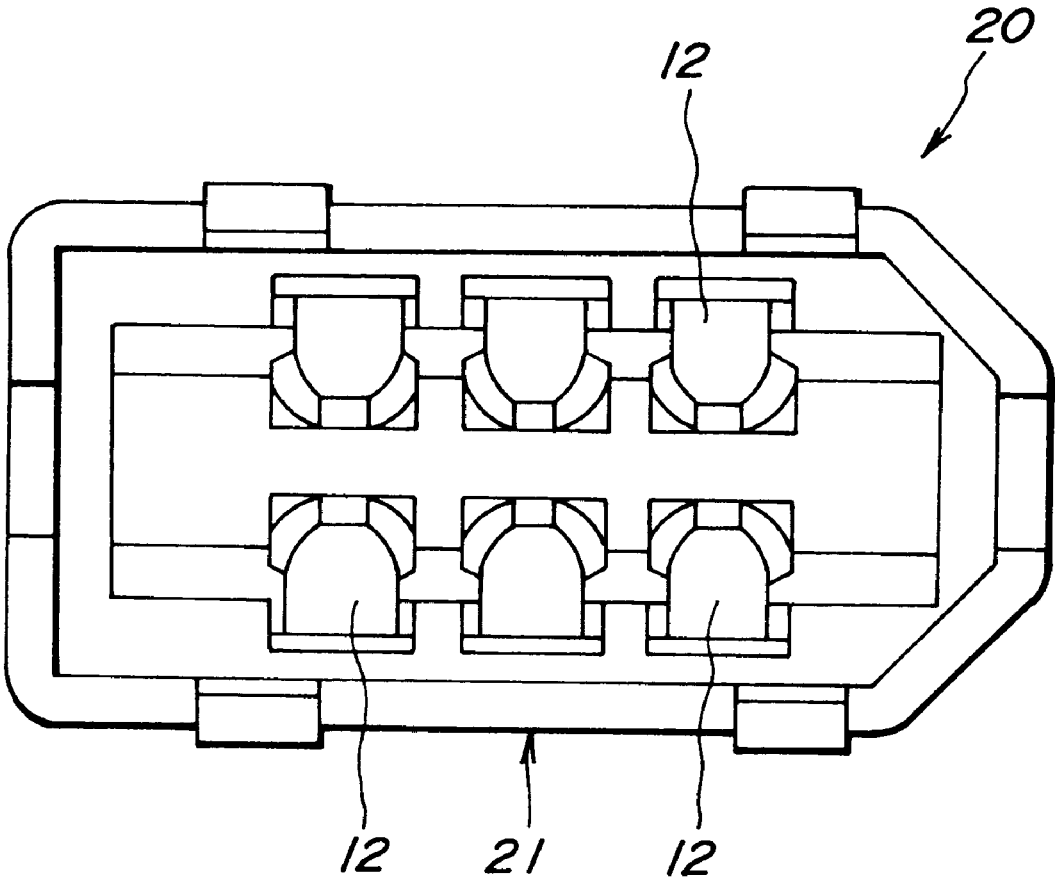
FIG. 8 is a front elevation showing the electrical connector shown in FIG. 6.

FIGS. 6 to 8 illustrate one example of an electrical connector provided therein with contacts 10 constructed as described above. The electrical connector 20 includes a case 21 made of a resin as a main body in which six contacts 10 are arranged in two rows one above the other (viewed in FIGS. 6 and 8) each including three contacts. The resin case 21 has a holder member 22 which slightly extends out of the case 21, and the slightly extended end of the holder member 22 has both upper and lower faces at which the connection portions 11 of the contacts 10 are exposed, respectively, so that these contacts 10 are compactly arranged in an extremely close relationship as shown in FIG. 7. In this case, the contacts 10 are arranged with the pitch the same as the pitch P with which the contacts are punched from a metal tape T as shown in FIG. 4.

An exposed conductor 31 of an electric wire 30 is connected by soldering to the connection portion 11 of each contact 10. On the other hand, the resin case 21 has on the opposite side of the exposed holder member 22 an opening 23 as a socket for a mating connector, in which the contact portions 12 of the contacts 10 are arranged. Moreover, the resin case 21 is usually covered on its outer surfaces with a cover of aluminum or the like.

Even if the connection portions 11 of a plurality of contacts 10 are arranged extremely closely or in high density, the connection portions 11 can be arranged with a wider interval than in the connection portions of the prior art because of the highest and lowest wall portions H1 and H2 opposite to each other. The same holds true in case of the intermediate height wall portions whose upper edges are inclined in opposite direction and opposite to each other to form a V-shaped figure viewed in a direction perpendicular to the paper surface of FIG. 6. Altogether, the adjacent connection portions 11 of the contacts 10 are kept in good insulated condition from each other.

With this arrangement, moreover, capacitances of the connection portions 11 of adjacent contacts are reduced to prevent occurrence of cross talk so that the contacts thus constructed can be effectively used with electrical signals of higher frequencies. In other words, the transmission characteristics can be improved by the contacts according to the invention. Explaining it by referring to stray capacitances C1 and C2 simply illustrated in FIGS. 4 and 5, it is clear from the fact that since the spaced distance between the adjacent connection portions 11 is longer according to the invention, its stray capacitance C1 is less than the stray capacitance C2 of the connection portion 111 of the prior art (C1<C2).

Figure 9:
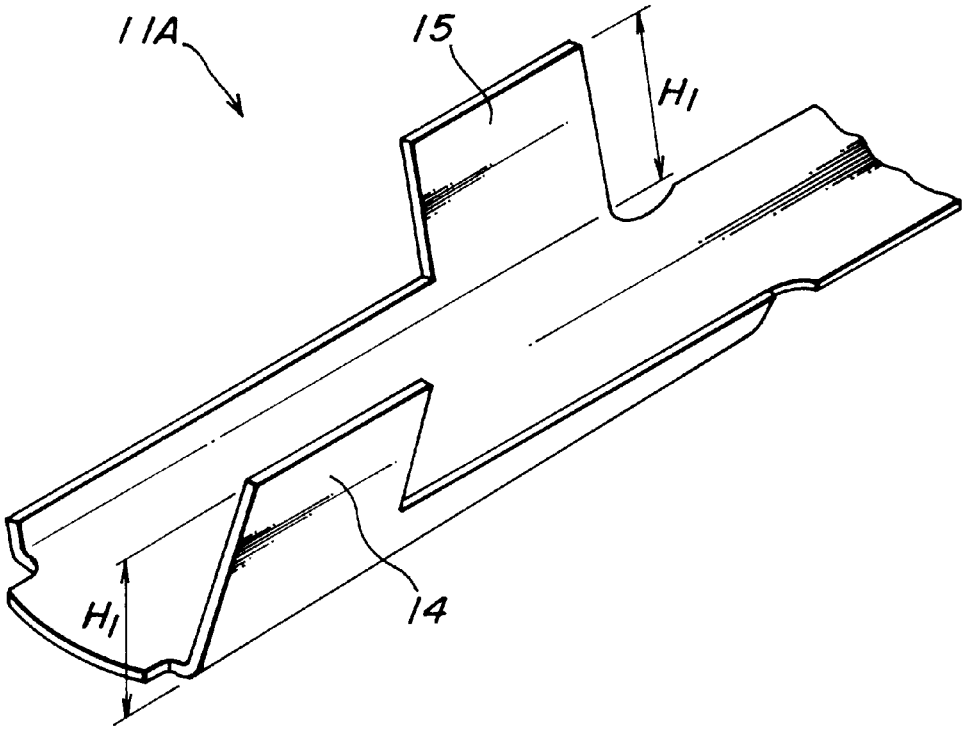
FIG. 9 is an enlarged perspective view illustrating the connection portion of a contact according to another embodiment of the invention.
Figure 10:
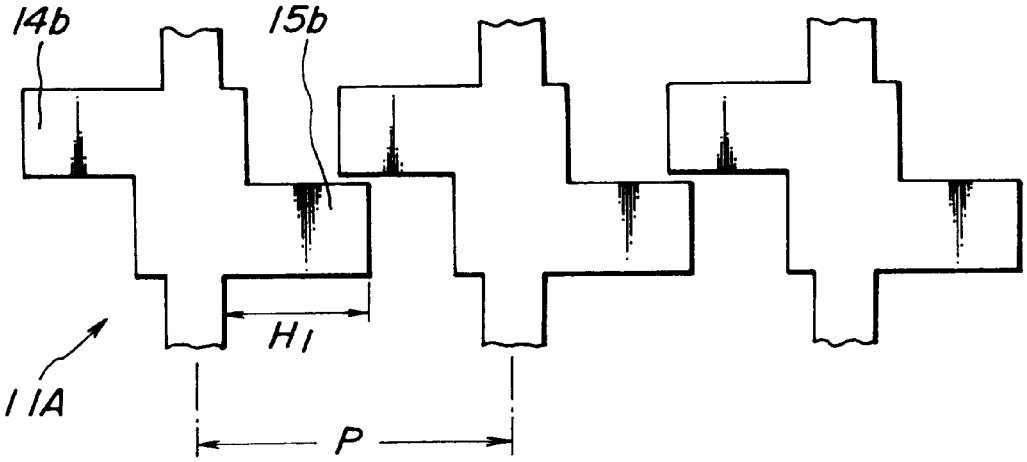
FIG. 10 is an enlarged plan view illustrating the connection portions of the contacts in the development state shown in FIG. 9.

FIG. 9 illustrates a connection portion in the form of a U-shaped groove of the contact for an electrical connector according to another embodiment of the invention. This connection portion 11A is fundamentally similar to the connection portion 11 shown in FIG. 3 with the exception that in the development state of bending pieces 14 and 15 prior to being bent, these pieces 14*b* and 15*b* on both the sides of the contact body are in the form of a rectangle extending from the contact body on both sides thereof and arranged shifted in the axial direction of the contact so as to be asymmetrical to each other with respect to the longitudinal axis of the contact as shown in FIG. 10.

In more detail, in the embodiment shown in FIG. 9, each of the bending pieces has a lowest portion and a highest rectangular portion having a height H1 located at one end of the U-shaped groove, and the highest rectangular portion is opposite to the lowest portion of the other bending piece.

In this embodiment, similarly, a deep and wide U-shaped groove is obtained in appearance, owing to the existence of the highest wall portions H1 at the longitudinal ends of the connection portion 11A irrespective of its small size as a whole. In this case, the height of the highest wall portions H1 can be freely adjustable such that it is made higher by extending the highest wall portion to the adjacent contacts in the design of a metal tape from which the contacts are formed by punching.

Figure 11:
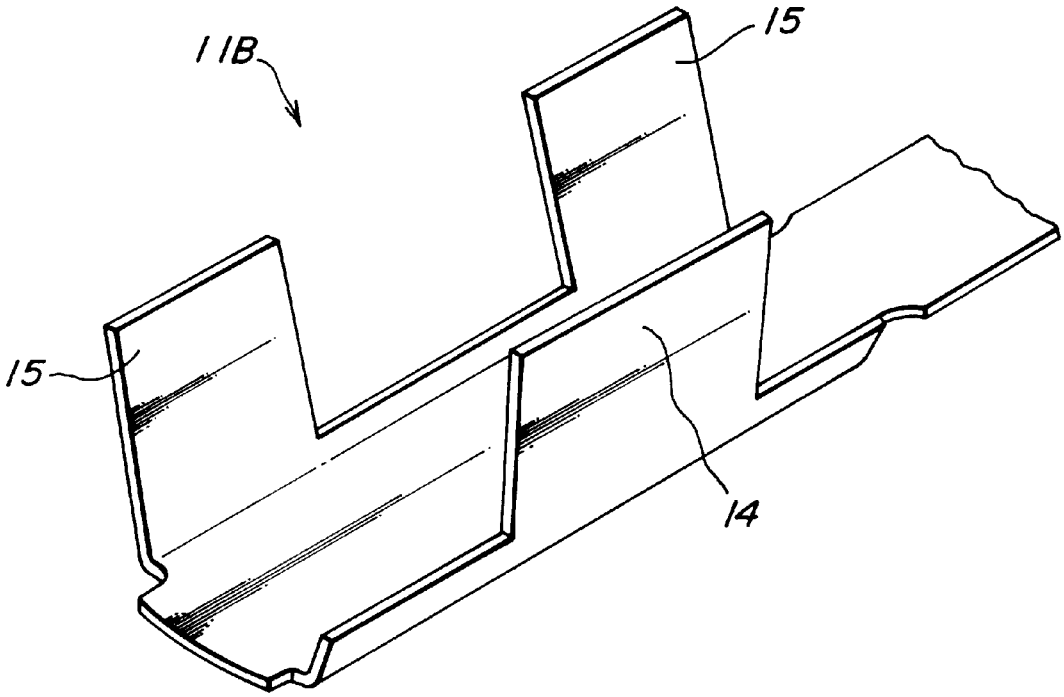
FIG. 11 is an enlarged perspective view illustrating the connection portion of a contact according to a further embodiment of the invention.
Figure 12:
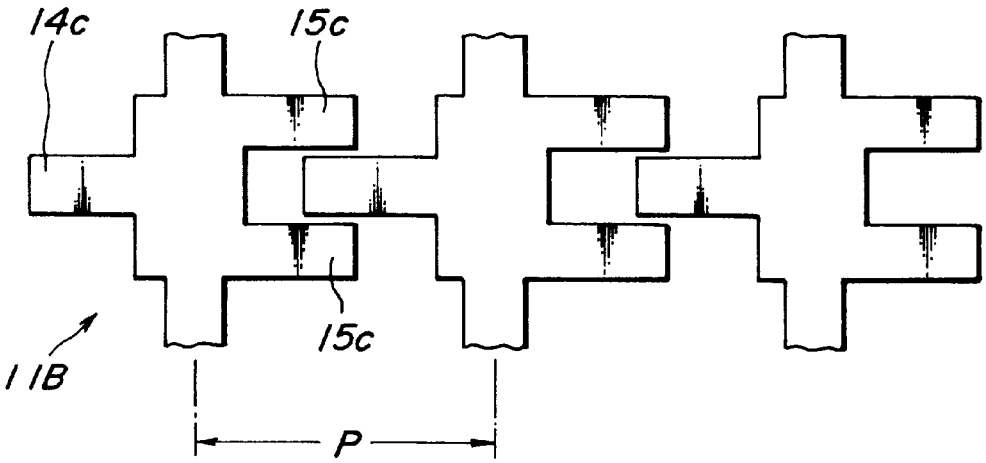
FIG. 12 is an enlarged plan view illustrating the connection portions of the contacts in the development state shown in FIG. 11.

FIG. 11 illustrates a connection portion in the form of a substantially U-shaped groove of the contact for an electrical connector according to a further embodiment of the invention. This connection portion 11B is fundamentally similar to the connection portion 11A shown in FIG. 9 with the exception that in the development state of pieces 14 and 15 prior to being bent, a single bending piece 14*c* on the left side and two bending pieces 15*c* on the right side are alternately and asymmetrically formed in a rectangular shape as shown in FIG. 12.

In more detail, in the embodiment shown in FIG. 11, one bending piece has one highest rectangular portion at its center and two lowest portions on both the sides of the highest rectangular portion, and the other bending piece has two highest rectangular portions at the ends of the U-shaped groove and one lowest portion between the two highest rectangular portions, and the highest and lowest portions are opposite to each other.

In this case, similarly, a deep and wide U-shaped groove is obtained in appearance although the connection portion 11B is small size as a whole, owing to the length (height) of the extension pieces 14*c* and 15*c* freely adjustable by extending them to the adjacent contacts in a similar manner in the connection portion 11A of FIG. 10.

While the invention has been particularly shown and described with the connection portions 11, 11A and 11B of the contacts 10 for electrical connectors, it will be understood by those skilled in the art that the present invention is also applicable to contacts for electrical or electronic equipment other than the electrical connector without being limited to those in the embodiments described above.

What is claimed is:

1. An electrical terminal having a connection portion of a deformable contact which is in a form of a substantially U-shaped groove defined by an interconnection of a pair of side walls between which is positioned an exposed conductor of an electric wire, wherein said side walls include bending portions above the U-shaped groove of the connection portion and are asymmetrically formed with respect to a longitudinal center line of said connection portion and wherein each of said bending portions are trapezoidal in shape, a shorter portion of the one trapezoidal bending portion is opposite to a longer base of the other trapezoidal bending portion at one end of the U-shaped groove and the shorter base of the other trapezoidal bending portion is opposite to the longer base of the other trapezoidal bending portion at the other end of the U-shaped groove, whereby to enhance a gripping function of the connection portion to the conductor by a diagonal grip line across the conductor.

2. A connection portion of a contact which is in a form of a substantially U-shaped groove within which is positioned an exposed conductor of an electric wire, and including deformable bending pieces defining the U-shaped groove of the connection portion which are asymmetrically formed and are deformed toward each other along a longitudinal axis of the contact to contain the conductor therebetween, and wherein each of said bending pieces forms a part of a rhomboid defining a U-shaped groove therebetween, and wherein each rhomboid portion includes a highest portion located at one end of the U-shaped groove, and the highest portion of the other rhombic portion is opposite to a lowest rhombic portion of the other bending piece, whereby to enhance a gripping function of the connection portion to the conductor by a diagonal grip line across the conductor.

3. The connection portion of a contact as defined by claim 2, wherein said bending pieces each forms a part of a rhomboid defining a U-shaped groove therebetween and which when deformed to enclose said conductor will define a pair of complementary longitudinal edges extending along an axis angularly related to the longitudinal axis of said conductor, whereby to enhance the gripping function of the connection portion to the conductor by the diagonal grip line across the conductor.

* * * * *